United States Patent [19]

Gonek

[11] 4,086,461

[45] Apr. 25, 1978

[54] HIGH-VOLTAGE CIRCUIT-INTERRUPTERS

[75] Inventor: Stanislaw Mieczyslaw Gonek, Newcastle-upon-Tyne, England

[73] Assignee: Reyrolle Parsons Limited, Newcastle-upon-Tyne, England

[21] Appl. No.: 618,249

[22] Filed: Sep. 30, 1975

[30] Foreign Application Priority Data

Oct. 1, 1974 United Kingdom ..... 42654/74
Jan. 31, 1975 United Kingdom ..... 4317/75

[51] Int. Cl.[2] ..... H01H 33/80

[52] U.S. Cl. ..... 200/148 R; 200/146 R; 200/148 D; 200/145; 200/144 AP

[58] Field of Search ..... 200/148 R, 148 D, 148 A, 200/150 G, 146 R, 144 AP

[56] References Cited

U.S. PATENT DOCUMENTS 3,801,763 4/1974 Marin ..... 200/148 R
3,855,436 12/1974 Marin ..... 200/148 R

*Primary Examiner*—Robert S. Macon
*Attorney, Agent, or Firm*—Watson, Cole, Grindle & Watson

[57] ABSTRACT

A high-voltage circuit-interrupter has a contact arrangement operating in compressed gas contained in a sealed vessel. The contact arrangement comprises a pair of spaced aligned tubular fixed contacts respectively connected to the terminals of the interrupter, and a pair of separable rooting electrodes mounted within the tubular fixed contacts and electrically connected respectively to them. A tubular bridging contact sleeve is slidably mounted on the tubular bridging contacts and is movable between a closed position bridging the spaced ends of the tubular contacts and an open position withdrawn from one of them to open a gap therebetween. The circuit-interrupter operating mechanism is arranged, for opening the interrupter, to withdraw the bridging contact sleeve from one of the fixed contacts and to initiate a gas blast through the gap so opened into the interiors of the fixed contacts and simultaneously or subsequently to withdraw one of the rooting electrodes from the other, so that the arc drawn between the bridging contact sleeve and one tubular fixed contact is transferred to the separated rooting electrodes and is then extinguished.

17 Claims, 7 Drawing Figures

HIGH-VOLTAGE CIRCUIT-INTERRUPTERS

This invention relates to high-voltage circuit-interrupters of the type for operation within an enclosure containing an insulating fluid medium, which may be gas or liquid and is particularly, although not exclusively, applicable to the type of circuit-breaker which comprises a sealed vessel housing one or more interrupter units within the insulating medium, for example SF6 gas.

An object of this invention is to provide an improved construction of the interrupter of the type specified which is simple and efficient in operation and economical in space and manufacture.

According to the present invention an interrupter of the type specified comprises a pair of tubular fixed contacts whose adjacent ends are spaced apart, the bore of each fixed contact containing a rooting electrode in electrical connection with the fixed contact, and at least one of the rooting electrodes being movable within its fixed contact so as to engage with and disengage from the other rooting electrode, and an external movable bridging contact being provided which retractibly engages and electrically bridges the spaced adjacent ends of the fixed contacts, means being provided for moving the bridging contact clear of the end of one of the fixed contacts and for introducing a jet or blast of the insulating medium at higher pressure than that in the interiors of the fixed contacts through the gap between the ends of the fixed contacts and into their interiors, and for simultaneously or subsequently moving one or each movable rooting electrode to separate the rooting electrodes so that a blast of the higher-pressure medium will be directed at an arc so drawn between the separated rooting electrodes.

One rooting electrode may consist of a plug fixed centrally within one of the fixed contacts, and the moving rooting electrode may be a hollow stem whose end portion surrounds the rooting electrode plug to make electrical contact therewith when the interrupter is closed.

One of the rooting electrodes may be movable and the other fixed, or alternatively both rooting electrodes may be movable into and out of contact with one another.

Preferably the spaced adjacent ends of the fixed hollow contacts are each provided with an arc-resistant insulating nozzle with an internal bore which is divergent in the direction downstream of the jet or blast, i.e. away from the end of the fixed contact. This enables an improvement of the voltage stress gradient within the gap between the tubular fixed contacts to be achieved. The nozzles may be provided with vent passages to direct some of arcing products out from the bores of the fixed contacts to the exterior of the contacts.

Movement of the bridging contact and release of the blast of higher-pressure medium are preferably initiated before separation of the electrode contacts, so that a flow of the higher-pressure insulating medium will be established within the fixed contacts before the separation of the electrode contacts, so that when they separate the stream of insulating medium is directed onto the arc formed between them in order to extinguish the arc.

In one arrangement of the invention, the bridging contact may itself constitute a blast valve controlling the introduction of the blast into the fixed contacts, and may take the form of an insulated sleeve having internal finger contacts of conducting material whose opposite ends respectively engage with the outside surfaces of the fixed contacts.

In such an arrangement the electrical circuit is such that two parallel paths are provided for carrying the current under the circuit-closed condition, and for reasons of economy of manufacture the major part of the current is carried by the outer parallel path comprising the bridging contact and fixed hollow contacts. The inner parallel path is through the separable rooting electrodes mounted within the tubular fixed contacts and respectively electrically connected thereto. It therefore follows that when the bridging contact is operated during the circuit-opening operation before all the current transferred into the inner path, it is necessary to break the residual current flowing in the outer path, and whilst this break takes place under the most favourable conditions with a blast of high pressure fluid currounding the resultant arc, a certain quantity of arcing products in the form of metal splashing is present, and since there are valve sealing parts of the blast valve in the region of the arcing products there is a danger of the valve sealing parts being damaged.

Another construction of the invention is aimed at avoiding this damage taking place, by separating the functions of the blast valve and the bridging contact whilst still retaining the simplicity of the constructional features and the economic advantages of the first-mentioned arrangement.

In this modified construction, the bridging contact carries blast valve sealing means for sealing cooperation with the fixed tubular contacts, and at least one of the fixed contacts, namely that from which the bridging contact will initially be withdrawn on operation of the interrupter, carries auxiliary contact means in permanent electrical connection therewith and arranged to make electrical contact with the bridging contact at a region spaced from, and preferably spaced externally of the said sealing means when the interrupter is in the closed position, and acting as an arcing electrode in cooperation with the bridging contact when the latter is withdrawn from the fixed contact on operation of the interrupter.

Preferably the other fixed contact also carries an auxiliary contact means which is in electrical contact with the bridging contact in all operative positions of the latter.

The bridging contact in this modified construction preferably comprises an open-ended cylindrical sleeve of electrically-conductive material such as copper or copper alloy, and carried resilient blast valve sealing means within its interior for co-action with the outer surfaces of the tubular fixed contacts.

The or each auxiliary contact means may comprise a ring formation surrounding the associated bridging contact.

The or each auxiliary contact means preferably includes resilient finger contact portions for maintaining good electrical contact with the outer surface of the bridging contact.

The dimensions of the or each auxiliary contact assembly are such as to ensure that any arcing which takes place between it and the bridging contact occurs substantially remote from the region of the blast valve sealing and seating, and externally thereof.

One or more of the interrupters may be contained in a sealed housing containing the insulating medium surrounding the interrupter, this medium being preferably SF6 gas at a pressure above atmospheric. Gas at the higher pressure required during circuit-breaking may be provided from a separate source, or may be generated with the housing by a puffer piston and cylinder which may be operated by the associated circuit-breaker operating mechanism.

The invention may be carried into practice in various ways, but two specific embodiments thereof will now be described by way of example only with reference to the accompanying drawings in which.

Figure 1:
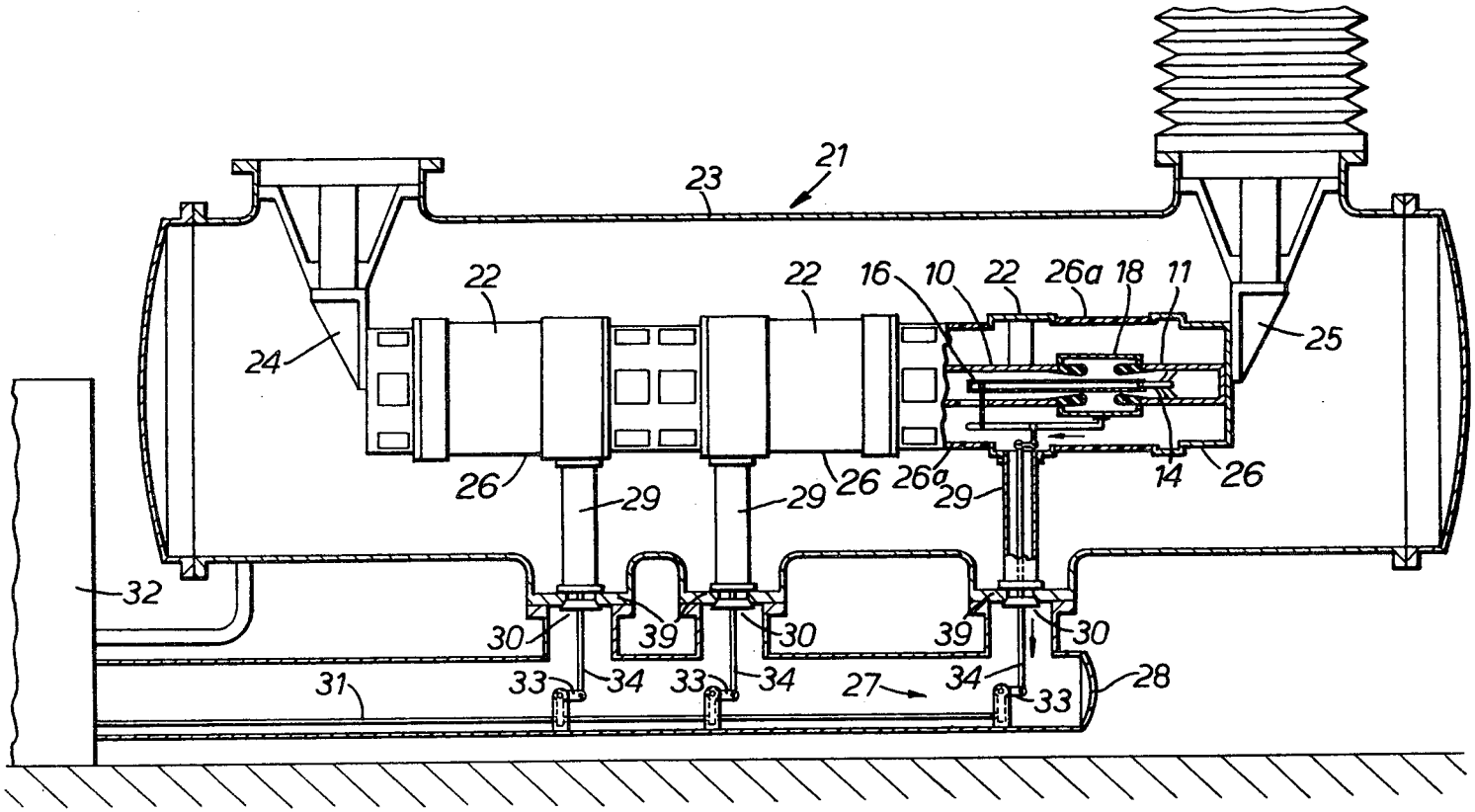
FIG. 1 illustrates diagrammatically in sectional side view a high-voltage circuit-breaker comprising three series-connected interrupter units mounted in a gas-filled vessel.

In the embodiment shown in FIGS. 1 to 4 a high-voltage circuit-breaker 21 comprises three interrupter units 22 mounted in a gas-filled tank 23 and electrically connected in series between circuit-breaker terminals 24 and 25. Each interrupter unit 22 comprises two spatially fixed hollow contacts 10, 11 of electrically conducting material, the opposing inner ends of which are provided with arcing nozzles 12, 13 of arc-resistant insulating material and have inwardly divergent throat portions 12*a*, 13*a*. Each throat portion is designed to suit the expanding arc column which is produced when an arc is drawn and which is a function of current, gas pressure and gas velocity. The contacts 10, 11 are mounted within a sealed inner vessel 26 mounted in the tank 23. The tank 23 contains insulating gas, for example SF6, at a low pressure above atmospheric pressure, which also fills the interiors of the vessel 4 and of the fixed contacts 10 and 11. The vessel 26 has insulating wall sections 26*a* in parallel with the contacts 10 and 11.

Figure 2:
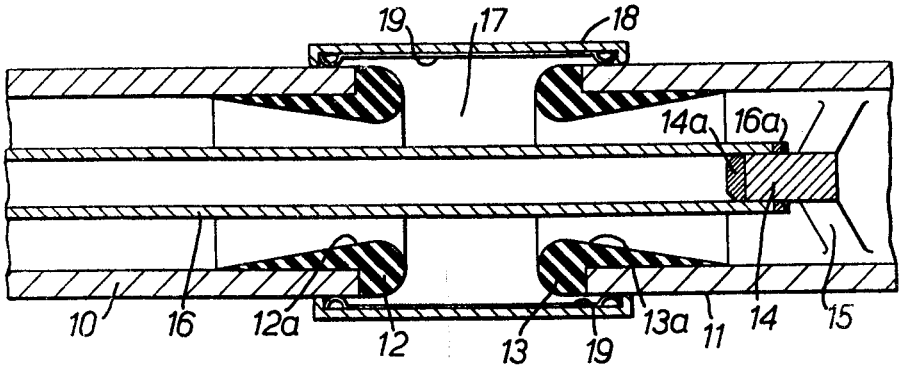
FIG. 2 shows in greater detail one construction of the contact arrangement of the interrupter unit of FIG. 2, at the stage when the interrupter is in the circuit-closed position.

Contact 11 contains a fixed plug electrode 14 having an arc-erosion-resistant tip 14*a* and being supported within and in electrical connection with the contact 11 by a support spider 15. An elongate movable stem electrode 16 extends within the fixed contact 10 and, as shown in FIGS. 1 and 2, extends into the fixed contact 11 and surrounds plug 14 in electrical contact therewith when the interrupter is closed. The movable electrode 16 is provided with an arc-erosion-resistant tip 16*a* (FIG. 2) at its inner end. The outer end of movable electrode 16 is in electrical connection with the fixed contact 10 and is connected to an operating mechanism 27, described below, which drives the movable electrode longitudinally into and out of engagement with the plug electrode 16. The electrodes 14 and 16 constitute the arc-rooting electrodes of the interrupter.

The gap 17 between the fixed contacts 10, 11 is bridged by a bridging contact member 18 which consists of a hollow cylindrical sleeve of insulating material containing a plurality of finger contacts 19 fixed to the inside wall of the sleeve. These contacts 19 are shown in FIG. 2 in a position in which they are in electrical contact with the two fixed contacts 10 and 11, to establish an electrical connection between them.

Prior to operation of the interrupter, in the condition shown in FIG. 2, the interrupter is surrounded by and filled with SF6 or other pressurised gas contained in the tank 23 and inner vessel 26 at a predetermined low pressure above atmospheric. This maintains insulation security in the "circuit-closed" position of the interrupter.

Figure 3:
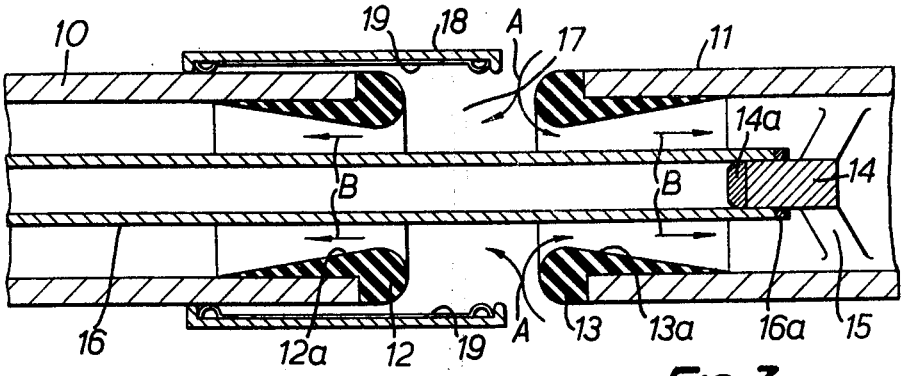
FIG. 3 is a view similar to FIG. 2 but with the interrupter at a stage of operation where the bridging contact has opened.

When the interrupter is operated to open the circuit by means of the operating mechanism 6 this firstly slides the bridging contact sleeve 18 off the exterior of the fixed contact 11, as shown in FIG. 3, to allow a blast of insulating gas at a higher pressure than that previously existing in the tank 23 to be directed through the gap 17 between the contacts 10 and 11 and through the nozzles 12, 13 into the hollow bores of contacts 10, 11 as indicated by arrows A, B in FIG. 3. The blast of higher-pressure gas referred to is provided by releasing gas from a separate stored-gas cylinder 28, as shown in FIG. 1, through a supply pipe 29 under the control of a valve 30; or by means of a puffer piston and cylinder, not shown. The latter may be operated by the interrupter operating mechanism 27 to increase the pressure of a volume of the insulating gas already within the tank and to direct it in the manner described.

Figure 4:
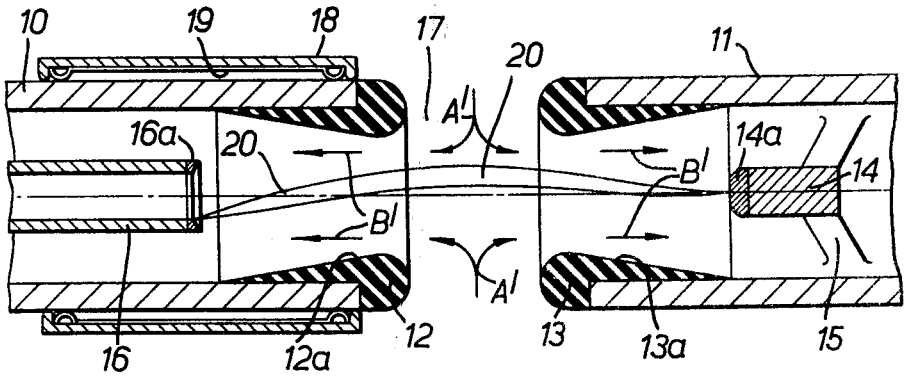
FIG. 4 is a view similar to FIGS. 2 and 3 but with the interrupter at the stage when the moving rooting electrode is separated from the fixed rooting electrode and an arc is established between them.

The movable electrode 16 is then driven to the left, as shown in FIG. 4, by the operating mechanism 27 and an arc 20 is thereby drawn between the arc-erosion-resistant tips 14*a* and 16*a* of the plug electrode 14 and movable electrode 16 respectively. By this time the sleeve 18 is fully open to allow the full available blast of the higher-pressure gas from the cylinder 28 to be directed through the gap 17 onto the arc 20, as shown by arrows A′, B′. The arcing products are directed down the bores of the hollow fixed contacts 10, 11 past the electrodes 16, 14 to filter means, not shown, and are then returned to the interior of the tank 23 outside the inner vessel 26. Extinction of the arc 20 to clear the circuit occurs at the appropriate current zero, and when restriking of the arc is no longer possible the high-pressure blast through the pipe 5 is cut off.

Figure 1A:
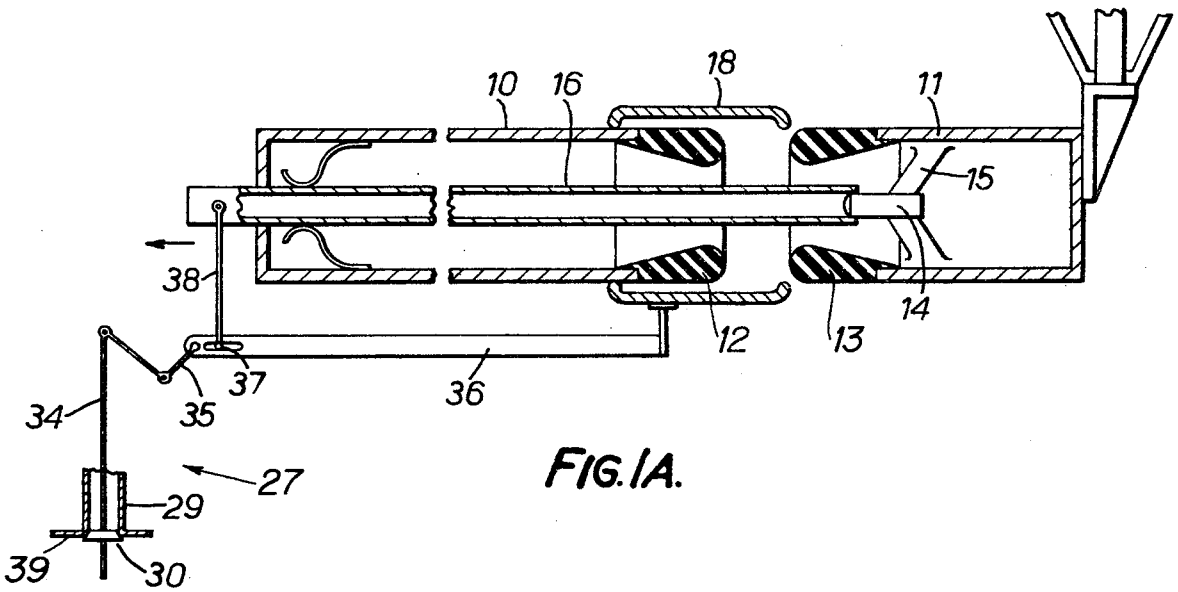
FIG. 1A is a diagram showing the contact arrangement and operating linkage of one of the interrupter units of FIG. 1.

The operating mechanism 26 is shown diagrammatically in greater detail in FIG. 1A. Thus a main operating rod 31 is driven longitudinally by an actuator housed in a control cubicle 32, and is linked by bell-crank levers 33 to individual vertical operating rods 34 leading through the supply pipe 29 into the three interrupter units 22. Movement of the main rod 31 to the left draws the three rods 34 downwardly to open the interrupter units, and vice versa. Each vertical rod 34 is coupled by a bell-crank lever 35 to a link 36 extending within the inner vessel 26 and coupled at one end to the bridging contact sleeve 18, and at the other by a pin-and-slot connection 37 to a member 38 depending from the movable rooting electrode 16. Thus downward movement of the vertical rod retracts the bridging sleeve 18 towards the left in FIG. 1 and 1A and, after a brief delay, also retracts the movable rooting electrode 16 towards the left.

Each vertical operating rod 34 carries a movable valve member 30 which engages a valve seat formed in a flange 39 of the tank 23 when the circuit-breaker is in the closed position. When the circuit-breaker is open the vertical downward movement of each rod 34 opens the associated valve 30 to admit high-pressure gas from the cylinder 28 into the pipe 29 and hence into the inner vessel 25 to provide the gas blasts for the interrupter contacts as described.

Closure of the interrupter onto a circuit is effected by the same operating mechanism 27, which drives the moving electrode 16 into engagement with the plug electrode 14 and also closes the bridging contact sleeve 18. In a normal closing operation the high-pressure gas supply would not be required since no arc is being drawn out, and the interrupter could operate during closure in the lower-pressure gas contained in the tank 23.

Figure 5:
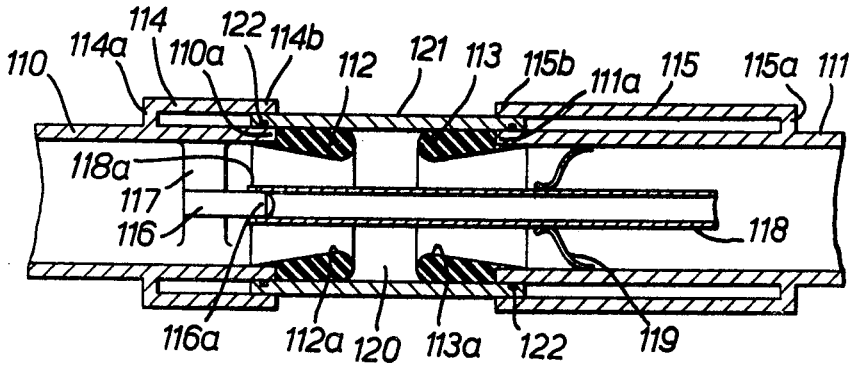
FIG. 5 is a view similar to FIG. 2 of an interrupter unit having a modified contact and blast valve arrangement shown in the circuit-closed position.
Figure 6:
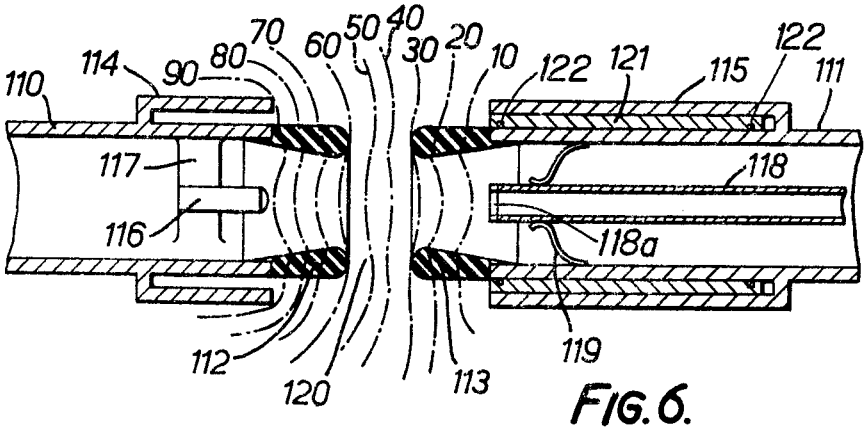
FIG. 6 shows the interrupter unit of FIG. 5 in the circuit-open position.

In the modified embodiment shown in FIGS. 5 and 6 the interrupter has two spatially-fixed hollow tubular contacts 110, 111 of electrically conducting material, the opposing inner ends of which are provided at their tips with arcing nozzles 112, 113 of arc-resistant insulating material having inwardly divergent throat portions 112*a*, 113*a*.

Fixed to the outsides of the spaced adjacent ends of both contacts 110, 111 are auxiliary contacts 114, 115. These contacts comprise cylinders of electrically conducting material, which may be of copper or a copper alloy, respectively fixed by web portions 114*a*, 115*a* to the outside surfaces of contacts 110, 111. Alternatively they may be formed integrally with the respective contacts 110, 111. The end portions 114*b*, 115*b* of the auxiliary contacts are each in the form of a plurality of resilient spring contact fingers, each set of which may be either machined from the cylinder wall or else may be a separate assembly brazed or the like to the cylinder; they may be of the same material as the cylinder, or may be made of an arc-erosion-resistant conducting material having greater resilience than the cylinder to which they are attached. It should be noted that they must project by a small amount, not visible on the drawing, beyond the end 110*a*, 111*a*, or the conducting part of the respective fixed contact. It will also be noted that the auxiliary contact 115 has a greater overall length than the contact 114.

Each throat portion 112*a*, 113*a* is designed to suit the expanding arc column which is produced when an arc is drawn and which is a function of current, gas pressure and gas velocity. Furthermore, since the dielectric withstand to high voltage, i.e. switching and lightning overvoltages, is, all else being equal, a function of the contact gap at the time the voltage appears, an additional improvement obtained by the use of insulating material for the interrupter nozzles 112 and 113 is that the gap between the nozzles need only be that required for gas flow conditions. The other requirement imposed upon existing designs is that of dielectric withstand voltage. By using an insulating material such as P.T.F.E. for the nozzles 112 and 113, the aerodynamic gap can be maintained at a minimum whilst the electrostatic gap can be increased to give improved dielectric withstand.

The fixed contact 110 contains a fixed plug electrode 116 having an arc-erosion-resistant tip 116*a* and being supported within and in electrical connection with the contact 110 by a support spider 117. An elongate movable stem electrode 118 extends within the fixed contact 111, and as shown in FIG. 5 extends into the fixed contact 110 and surrounds the plug 116 in electrical contact therewith when the interrupter is closed. The movable electrode 118 is provided with an arc-erosion-resistant tip 118*a* at its end. The other movable electrode 118 is slidably connected electrically to the fixed contact 111 by a contact cluster 119 and is connected to an operating mechanism 27 as previously described, which drives the movable electrode into and out of engagement with the plug electrode 116. The electrodes 116 and 118 constitute the arc rooting electrodes of the interrupter.

The gap 120 between the fixed contacts 110, 111 is bridged by a bridging contact member 121 which consists of a hollow cylindrical sleeve of conducting material, which may be copper or copper alloy; valve sealing is provided by sealing rings 122 fixed in channels in the inside wall of the sleeve 121. These rings are resilient and provide a gas-tight seal when in contact with the outer surfaces of contacts 110, 111 to fulfill the blast valve function. Alternatively spring-loaded seals may be employed to fulfill the same function.

The various interrupter contacts in the arrangement of FIGS. 5 and 6 are again housed in an inner gas-filled vessel 26 in the tank 23, but in this case the gas valves 30 are not provided and the inner vessel is therefore permanently at the same high gas pressure as the cylinder 28, since the bridging contact sleeves 121 themselves constitute the blast valves.

As will be seen in FIG. 5, the finger ends 114*b*, 115*b* of the auxiliary contacts 114, 115 bear on the outside of the bridging contact sleeve 121 and are resiliently biased to make good electrical contact therewith so that a circuit is formed through the fixed contact 110, auxiliary contact 114, bridging contact 121, auxiliary contact 115 and fixed contact 111. This circuit is in parallel with that through the fixed contact 110, electrode 116, electrode 118, contacts 119 and contact 111.

Prior to operation of the interrupter, in the condition shown in FIG. 5, the interrupter is surrounded by and filled with SF6 or other pressurised gas contained in the surrounding tank 23 at a predetermined pressure above atmospheric. This maintains insulation security in the "circuit-closed" position of the circuit-breaker.

When the interrupter is operated to open the circuit by means of the operating mechanism 27, this firstly slides each bridging contact sleeve 121 off the exterior of the conducting fixed contact 110, and clear of the auxiliary contact 114; the arc drawn during this operation is restricted to the outside of the bridging contact sleeve 212 and to the finger ends 114*b* of the auxiliary contact 114, thus preventing any arcing products from contaminating the blast seal 122. Withdrawal of the bridging contact sleeve 121 from the contact 110 and nozzle 112 allows a blast of insulating gas at the higher pressure existing in the inner vessel 26 to be directed through the gap 120 between the insulating nozzles 112 and 113 which form the tips of the contacts 110 and 111 and through the nozzles 112 and 113 into the hollow bores of contacts 110 and 111. The blasts of higher-pressure gas referred to may alternatively be provided by means of a puffer piston and cylinder, not shown, for example as described in our co-opending British patent application No. 4316/75. The latter may be operated by the interrupter operating mechanism 27 to increase the pressure of a volume of the insulating gas already within the tank and to direct in ti the manner described.

When the bridging contact sleeve 121 is being withdrawn as described, the current path is transferred to the inner path comprising fixed contact 110, rooting electrode 116, elongate electrode 118 and fixed contact 111, and subsequent movement by the operating mechanism 27 drives the movable electrode 118 to the right in the drawing to the final "circuit-open" position shown in FIG. 6. In arriving at this position an arc is drawn between the arc-erosion-resistant tips 116*a*, 118*a* of the plug electrode 116 and movable electrode 118 respectively. By this time the sleeve 121 is fully open to allow the full available blast to be directed through the gap 120. The arcing products are directed down the bores of hollow contacts 110, 111 and past electrodes 116, 118 to filter means, not shown, and are then returned to the interior of the tank 23 outside the inner vessel 26. Extinction of the arc to clear the circuit occurs at the appropriate current zero.

Closure of the interrupter onto a circuit is effected by the same operating mechanism 27, which drives the moving electrode 118 into engagement with the fixed electrode 116 and also closes the bridging contact sleeve 121. In the normal closing operation the high pressure supply would not be required since no arc is being drawn out, and the interrupter could operate during closure at the lower pressure of the gas contained in the tank 23.

In FIG. 6 the dotted lines numbered 10, 20 . . . 90 indicate the stress gradient lines of equipotential, and as can be seen these indicate that the voltage gradient across the gap is improved so that in determining the spacing between the insulating nozzles 112, 113 the aerodynamic gap can be maintained at an optimum without the need to increase the gap to give improved dielectric withstand, i.e. the length of the insulating nozzles can be increased to compensate for this.

It should be noted that in the construction of FIGS. 5 and 6 the bridging contact and blast seals may be modified and the auxiliary contacts can also take other forms.

Furthermore, it will be understood that the invention is not restricted to the forms of construction illustrated, and many variations in detail may be made.

Thus, a supply of the SF6 gas at a pressure higher than that in the main tank 23 and in the interiors of the fixed contacts 10, 11 or 110, 111 may be contained in an annular compartment sealed around the adjacent ends of the fixed contacts and enclosing the bridging contact sleeve 18 or 121. The sleeve 18 of FIGS. 2 to 4 would in this case be in sealed slidable engagement with the exteriors of the two fixed contacts 10 and 11, and in each construction the sleeve 18 or 121 would operate as a blast valve to control the admission of the gas blast into the interiors of the contacts 10 and 11, or 110 and 111. Alternatively, the higher-pressure gas could be stored in a separate bottle within the main enclosure 23, the bottle having its own control valve which would be opened simultaneously with the withdrawal of the bridging contact sleeve 18 or 121 by the operating mechanism 27.

In the case where the higher-pressure gas blast is produced by a puffer, the piston of the puffer would be coupled to the sliding bridging contact sleeve 18 or 121 so that the latter would be opened by the operating mechanism simultaneously with the movement of the puffer piston to initiate the gas blast.

Additional venting may be provided in the region of the arcing nozzles 12, 13 or 112, 113 in the form of holes through the walls of the nozzles.

The invention is also not restricted to the use of SF6 gas as the insulating medium, but some other insulating gas could be used, or even a liquid such as oil.

What we claim as our invention and desire to secure by Letters Patent is:

1. A high-voltage circuit-interrupter having a contact arrangement for operation within an enclosure containing an insulating fluid medium, the interrupter comprising a pair of tubular fixed contacts having adjacent ends spaced apart, and each fixed contact including a bore containing a rooting electrode in electrical connection with the fixed contact, and at least one of the rooting electrodes being movable within its fixed contact to engage with and disengage from the other rooting electrode, and an external movable bridging contact which retractibly engages and electrically bridges the spaced adjacent ends of the fixed contacts, circuit-breaker operating means for moving the bridging contact clear of the end of one of the fixed contacts and for introducing a jet stream of the insulating medium at higher pressure than that in the interiors of the fixed contacts through the gap between the ends of the fixed contacts and into the interiors thereof, the spaced adjacent end of each of the tubular fixed contacts includes an arc-resistant insulating nozzle having an internal bore diverging in a direction downstream of the jet stream and away from the end of the respective fixed contact, and the circuit-breaker operating means operating at least one movable rooting electrode to separate the rooting electrodes so that the jet stream of the higher-pressure medium is directed at an arc drawn between the separated rooting electrodes.

2. An interrupter as claimed in claim 1 in which one rooting electrode comprises a plug fixed centrally within one of the fixed contacts, and the moving rooting electrode comprises a hollow stem having an end portion surrounding the rooting electrode plug to make electrical contact therewith when the interrupter is closed.

3. An interrupter as claimed in claim 1 in which one rooting electrode is movable and the other is fixed.

4. An interrupter as claimed in claim 1 in which both rooting electrodes are movable into and out of contact with one another.

5. An interrupter as claimed in claim 1 in which each of the arc-resistant insulating nozzles includes vent passages to direct some of the arcing products out from the bores of the fixed contacts to the exterior thereof.

6. An interrupter as claimed in claim 1 in which the movement of the bridging contact and release of the jet stream of higher-pressure insulating medium are arranged to be initiated before separation of the rooting electrodes, so that a flow of the higher-pressure insulating medium is established with the fixed contacts before the separation of the rooting electrodes, whereby on separation of the rooting electrodes the stream of insulating medium is directed onto the arc formed between the rooting electrodes to extinguish the arc.

7. An interrupter as claimed in claim 1 further comprising a sealed housing containing the insulating fluid medium surrounding the interrupter.

8. An interrupter as claimed in claim 7 in which the insulating fluid medium is SF6 gas at a super-atmospheric pressure.

9. An interrupter as claimed in claim 7 further comprising a separate source of gas at the higher pressure required at the jet stream during circuit operation.

10. An interrupter as claimed in claim 7 further comprising a puffer piston and cylinder arrangement within the housing, and arranged to be operated by the associated circuit-breaker operating means and to generate the supply of gas at higher pressure required by the jet stream during circuit-breaker operation.

11. An interrupter as claimed in claim 1 in which the bridging contact constitutes a blast valve controlling the introduction of the jet stream into the fixed contacts, and comprising an insulated sleeve having internal finger contacts of conducting material having opposite ends respectively engaging the outside surfaces of the fixed contacts.

12. An interrupter as claimed in claim 1 in which the bridging contact carries blast valve sealing means for sealing cooperation with the fixed tubular contacts, and at least one of the fixed contacts from which the bridging contact is initially withdrawn on operation of the interrupter, carrying auxiliary contact means and arranged to make electrical contact with the bridging contact at a region spaced from the sealing means when the interrupter is in the closed position, the auxiliary contact means functioning as an arcing electrode in cooperation with the bridging contact when the latter is withdrawn from the fixed contact on operation of the interrupter.

13. An interrupter as claimed in claim 12 in which the other fixed contact also carries an auxiliary contact means in electrical contact with the bridging contact in all operative positions of the latter.

14. An interrupter as claimed in claim 12 in which the bridging contact comprises an open-ended cylindrical sleeve of electrically-conductive material, and carries resilient blast valve sealing means within its interior for co-action with the outer surfaces of the tubular fixed contacts.

15. An interrupter as claimed in claim 13 in which each auxiliary contact means comprises a ring formation surrounding the associated bridging contact.

16. An interrupter as claimed in claim 13 in which each auxiliary contact means includes resilient finger contact portions for maintaining electrical contact with the outer surface of the bridging contact.

17. An interrupter as claimed in claim 13 in which the dimensions of each such auxiliary contact means ensure that the arcing between it and the bridging contact occurs substantially remote from the region of the blast valve sealing means, and externally thereof.

* * * * *